United States Patent [19]

Kojima et al.

[11] Patent Number: 4,612,060

[45] Date of Patent: Sep. 16, 1986

[54] PROCESS FOR CONTROLLING ZINC PHOSPHATE TREATING SOLUTIONS

[75] Inventors: Ryuiji Kojima; Naomi Suzuki; Yokichi Sato, all of Tokyo; Tsuneo Saito, Kanagawa, all of Japan

[73] Assignee: Parker Chemical Company, Madison Heights, Mich.

[21] Appl. No.: 704,819

[22] Filed: Feb. 25, 1985

[30] Foreign Application Priority Data

Feb. 29, 1984 [JP] Japan ..... 59-37670

[51] Int. Cl.[4] ..... C23C 22/12

[52] U.S. Cl. ..... 148/6.15 Z

[58] Field of Search ..... 148/6.15 Z

[56] References Cited

U.S. PATENT DOCUMENTS 4,182,638 1/1980 Cooke ..... 148/6.15 Z 4,515,643 5/1985 Knaster ..... 148/6.15 Z

*Primary Examiner*—Sam Silverberg

*Attorney, Agent, or Firm*—Arthur E. Kluegel

[57] ABSTRACT

A process for controlling the zinc or zinc and nickel content of a zinc phosphate conversion coating solution employs the addition of EDTA and titration with calcium ion using a calcium ion electrode. Preferably to a second sample is added EDTA and a thioglycolate and the same titration conducted to obtain the concentration of nickel ion for direct control purposes.

4 Claims, 7 Drawing Figures

Fig. 1
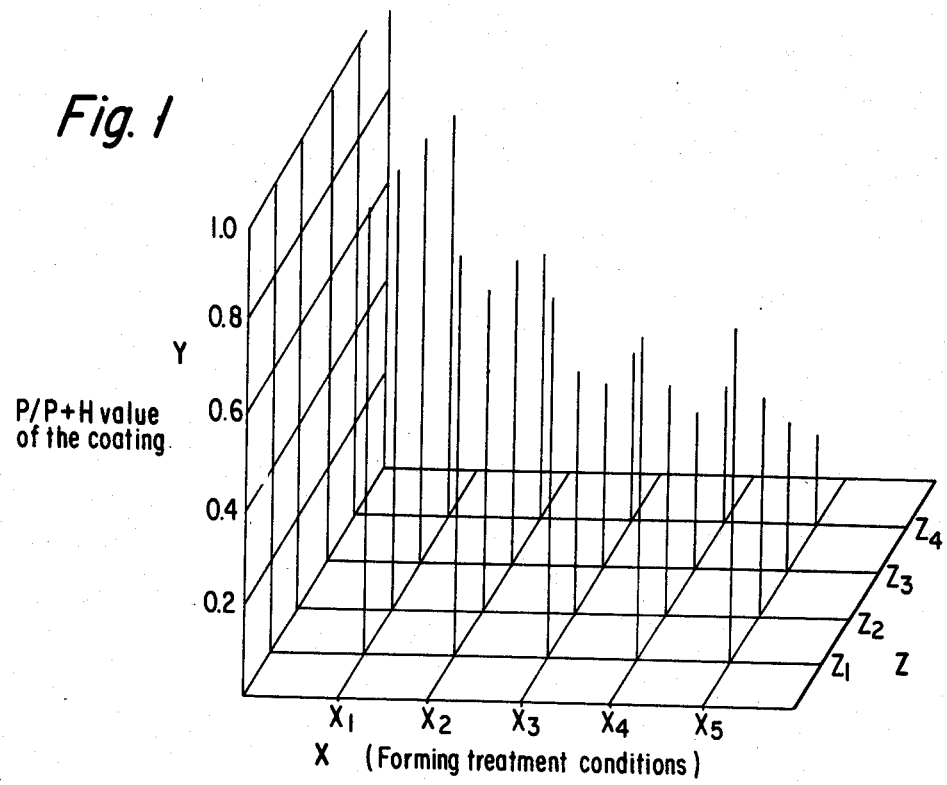
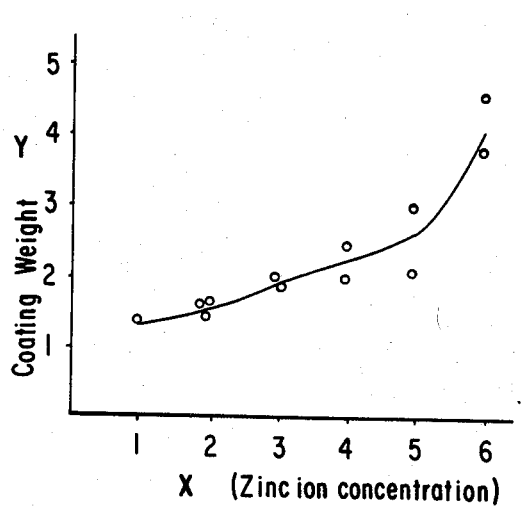
Fig. 2

Fig. 3
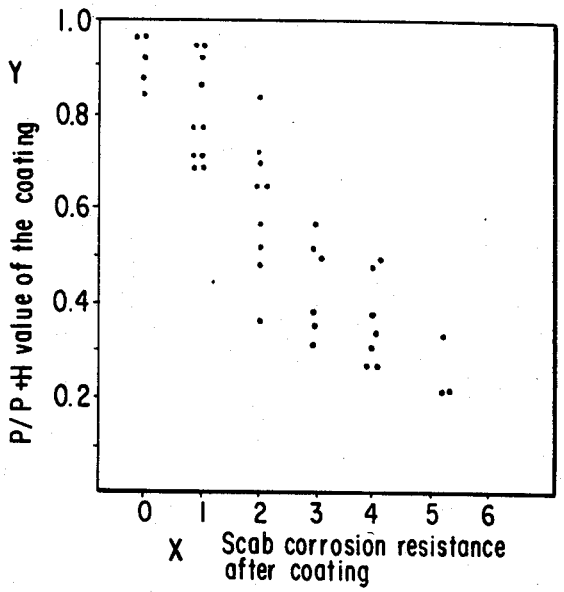
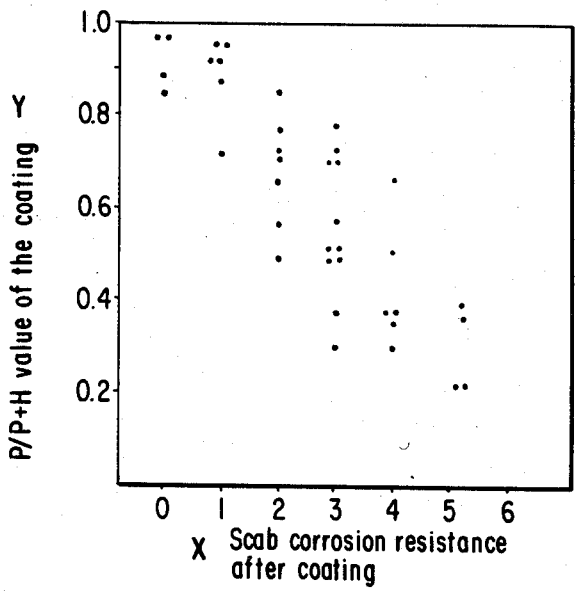
Fig. 4

PROCESS FOR CONTROLLING ZINC PHOSPHATE TREATING SOLUTIONS

BACKGROUND OF THE INVENTION

The invention is concerned with a method of controlling the zinc phosphate based conversion coating treatment solutions (referred to below as treatment solutions) which are used as a coating pretreatment or as an anti-rust or plastic deformation lubrication pretreatment for metals, especially steel and zinc plate.

When a zinc phosphate coating (referred to below as a coating) is formed on the surface of a metal the weight of the coating, the corrosion resistance after painting and the adhesion of the paint etc. are generally known to be affected to a considerable degree by the composition of the treatment solution employed and by the changes which occur in the composition of this solution. Hence it is very important that the composition of the treatment solution selected should have component concentrations, and especially the zinc ion and the zinc ion+nickel ion concentrations, within the preferred range and that these concentrations should be maintained within the preferred range if coatings which have the best possible properties are to be formed consistently on the surface of the metal which is being treated.

The control of the component concentrations in the treatment solution is achieved conventionally by measuring the free acid, total acid and promotor concentrations. These measurements are made using neutralization titration or redox titration methods and they can be carried out either manually or automatically. Although it is possible to control the free acid, total acid and promotor concentrations in the treatment solution using methods of this type it is very difficult to control the zinc ion and the zinc ion+nickel ion concentrations in the treatment solution to within the preferred ranges in this way.

SUMMARY OF THE INVENTION

The inventors have therefore investigated methods for controlling the zinc ion concentration and the zinc+nickel ion concentration in the treatment solution with a view to overcoming this problem and as a result of this work, it has been discovered that the zinc ion concentration or the zinc ion+nickel ion concentraion in the treatment solution can be controlled easily using the following procedures:

(1) Adding ethylenediaminetetra-acetic acid (referred to below as EDTA) to a sample of the treatment solution, titrating the excess EDTA with an aqueous solution of calcium chloride using a calcium ion electrode and then obtaining the zinc ion concentration or the total zinc ion+nickel ion concentration from the titre by calculation.

(2) Adding ammonium thioglycolate and EDTA to a sample of the treatment solution, titrating the excess EDTA with an aqueous solution of calcium chloride using a calcium ion electrode and then obtaining the nickel ion concentration from the titre by calculation.

(3) Determining the total zinc ion+nickel ion concentration in the treatment solution as described in (1) above, determining the nickel ion concentration in the said treatment solution with an appropriate method and then obtaining the zinc ion concentration in the solution by subtracting the latter value from the former value.

DESCRIPTION OF THE DRAWINGS

FIG. 1 is a ternary diagram which shows the relationship between the zinc ion concentration, the treatment conditions and the P/P+H value of the coating formed on the surface of the steel sheet when automobile steel sheet was subjected to a forming treatment in treatment solutions with four different zinc ion concentrations.

FIG. 2 is a graph of the relationship between the zinc ion concentration of the treatment solution and the weight of the coating.

FIG. 3 is a graph of the value of P/P+H for the coating and the scab corrosion resistance when a coating had been applied by anionic electrodeposition after forming the coating.

FIG. 4 is a graph of the value of P/P+H for the coating and the scab corrosion reistance when a coating had been applied by cationic electrodeposition after forming the coating.

Figure 5:
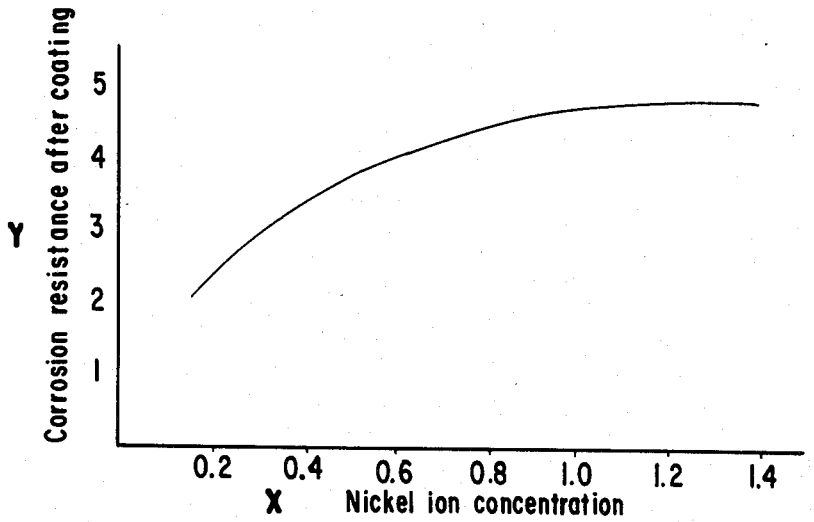
FIG. 5 is a graph of the relationship between the nickel ion concentration in the treatment solution and the corrosion resistance of the coating formed with that treatment solution.

1—Spray treatment zone, 2—Treatment solution tank, 3, 7, 8 and 9—Pumps, 4, 5 and 6—Service tanks, 10 and 15—Needle valves, 11—Pressure reducing value, 12 and 14—Electromagnetic valves, 13—Check valve, 16, 26, 27, 28 and 29—Prominent pumps, 17—Cell, 18—Calcium ion electrode, 19—Reference elctrode, 20—Stirrer, 21, 33 and 34—Drain valves, 22, 23 and 24—Reagent tanks, 25—Titrant tank, 30—Output converter, 31—Promotor concentration measuring device, 32—Total acid concentration measuring device, 35—Control part.

DETAILED DESCRIPTION OF THE INVENTION

The method of control of this invention is such that in the case of a zinc phosphate conversion coating treatment solution which does not contain nickel ions the zinc ion concentration in the said solution can be controlled using method (1) described above and in the case of a zinc phosphate conversion coating treatment solution which does contain nickel ions the zinc ion concentration and the nickel ion concentration can be controlled for example by determining the total zinc ion+nickel ion concentration in the treatment solution using the aforementioned method (1), determining the nickel ion concentration in the solution using the aforementioned method (2) and then determining the zinc ion concentration as the difference between the former concentration and the latter concentration using the aforementioned method (3).

The importance of the control of the zinc ion concentration and the zinc ion+nickel ion concentration is described below before proceeding with the description of an example of the invention.

It has been found in recent years that the thinner coatings which provide superior corrosion resistance and paint adhesion are fine undercoatings in which one of the main components is phosphophilite ($Zn_2Fe($-

$PO_4)_2.4H_20$). Coatings of this type have a structure consisting of Hopite ($Zn_3(P0_4)_2.4H_20$) and phosphophilite, and the following ratio is employed as a measure of the proportion of phosphophilite in the coating.

$$P/P+H$$

(P—x-ray intensity of the phosphophilite (100) plane, H—x-ray intensity of the Hopite (100) plane).

The value of P/P+H approaches 1 as the phosphophilite content of the coating increases and conversely the value of this ratio falls as the hopite content of the coating increases and the phosphophilite content falls.

FIG. 1 is a ternary diagram which shows the relationship between the zinc ion concentration in the treatment solution, the treatment conditions and the value of P/P+H for the coating which is formed on the surface of cold rolled steel sheet on carrying out forming treatments using the procedures described in Table 2 with four types of treatment solution which had different zinc ion concentrations for use with automobile steel sheet (JIS-G-3141, SPCC-D) as shown in Table 1.

TABLE 1

| Composition of the Treatment Solutions | |
|---|---|
| Component | Concentration (g/l) |
| Zn | $Z_1 = 0.72$ |
| | $Z_2 = 1.24$ |
| | $Z_3 = 1.65$ |
| | $Z_4 = 2.16$ |
| $PO_4$ | 15 |
| $ClO_3$ | 0.5 |
| $NO_2$ | 0.1 |

TABLE 2

| Treatment Conditions | | | |
|---|---|---|---|
| | Treatment Conditions | | |
| Process | $X_1$ | $X_2,X_3,X_4$ | $X_5$ |
| Degreasing | | Mild alkaline cleaner 20 g/l, 58° C. | |
| | One minute spray followed by a 2 minute dip | One minute spray followed by a 2 minute dip | 2 Minute spray |
| Water Rinse | Normal temperature 20 second spray | Normal temperature 20 second spray | Normal temperature 20 second spray |
| Surface Activiation | Titanium Activating Rinse, 3 g/l, 15 second spray | — | — |
| Conversion Coating | Two minute dip, 57° C. | 57° C. | Two minute spray 57° C. |
| | | Pre-spray (sec) / Dip (min) | |
| | | $X_2$ 15 2 | |
| | | $X_3$ 30 2 | |
| | | $X_4$ 45 2 | |
| Water Rinse | Normal temperature 20 second spray | Normal temperature 20 second spray | Normal temperature 20 second spray |
| Deionized Water Rinse | Normal temperature 15 second spray | Normal temperature 15 second spray | Normal temperature 15 second spray |
| Drying | Electric oven, 2 minutes at 105° C. | Electric oven, 2 minutes at 105° C. | Electric oven, 2 minutes at 105° C. |

The forming treatment conditions X in Table 2 are such that $X_1$ involved a dipping treatment, $X_2$, $X_3$, and $X_4$ involved first spraying the steel sheet (referred to below as a prespray) and then dipping the steel sheet in the same treatment solution, the duration of the prespray being different in each case as shown in Table 2, and $X_5$ involved in spraying treatment with the treatment solution only. Y is the value of P/P+H for the skin film and Z in the zinc ion concentration (g/l) in the treatment solution. Thus $Z_1=0.72$, $Z_2=1.24$, $Z_3$32 1.65 and $Z_4=2.16$.

According to FIG. 1 the value of Y increases from 0.84 ($Z_4$) to 0.97 ($Z_1$) under the conditions $X_1$, from 0.56 ($Z_4$) to 0.86 ($Z_1$) under the conditions of $X_2$, from 0.36 ($Z_4$) to 0.77 ($Z_1$) under the conditions of $X_3$, from 0.30 ($Z_4$) to 0.71 ($Z_1$) under the conditions of $X_4$ and from 0.21 ($Z_4$) to 0.72 ($Z_1$) under the conditions of $X_5$ and in all cases the value of P/P+H tended to increase as the concentration of zinc ions in the treatment solution was reduced. That is to say the zinc ion concentration in the treatment solution should be controlled at a low level to form coatings which have a high phosphophilite content. Thus although there is some difference due to the treatment conditions employed it is possible to form coatings which have a comparatively high P/P+H value, which is to say coatings in which the phosphophilite content is comparatively high, by maintaining a zinc ion concentration of about 0.7 g/l in the treatment solution. It is therefore very important that the optimum zinc ion concentration in the treatment solution and the range within which it should be maintained should be obtained and that the zinc ion concentration should be controlled within this range.

The relationship between the concentration of zinc ion in the treatment solution and the coating weight is shown in FIG. 2, where X is the zinc ion concentration (g/l) in the treatment solution and Y is the coating weight. The relationship between X and Y was obtained by degreasing samples of the aforementioned automobile steel sheet by spraying with a weakly alkaline cleaner, rinsing the steel with water and then treating with a zinc phosphate based conversion coating agent in which the zinc ion concentration differed within the range 1–6 g/l and then measuring the weight of the coating after rinsing with water and drying. It is well known that a low coating weight and a fine film are preferred as an undercoat for coatings and the weight of the undercoating is an important factor. It is clear from FIG. 2 that the weight of the coating tends to fall as the zinc ion concentration is reduced and so careful control of the zinc ion concentration is of importance from this point of view.

The relationships between the value of P/P+H for the coating and the corrosion resistance when a three coat coating process including the electrodeposition of a coating under the conditions described below on top of the conversion coating had been carried out are shown in FIGS. 3 and 4. FIG. 3 relates to anionic electrodeposition and FIG. 4 relates to cationic electrodeposition, the other coating conditions being the same in both cases. In FIGS. 3 and 4, X is the scab corrosion resistance after coating obtained using the test procedure outlined below, a value of zero indicating the best result while larger values indicate worsening results to the worst possible result which has a value of 6. Y has the same significant as in FIG. 1.

Three Coat Coating

| | |
|---|---|
| Anionic Electrodeposition: | Polybutadiene system, voltage 150 V, 22.0 coulomb/$dm^2$, |

-continued

| | |
|---|---|
| | 170° C., 20 minute bake. |
| Cationic Electrodeposition: | Epoxy system, voltage 175 V, 9.8 coulomb/dm$^2$, 185° C., 20 minute bake. |
| Intermediate Coat: | Melamine alkyd system, 140° C., 20 minute bake. |
| Top Coat: | Melamine alkyd system, 140° C., 20 minute bake. |

Outline of the Scab Corrosion Test

The coated sheet is immersed in water at 38° C. for 5 days and dried. Immediately after drying 100¼ inch nuts are dropped freely down a vinyl chloride resin pipe of diameter 5 cm onto the coated sheet from a position 4.5 meters above the coated sheet to damage the coated sheet which is then subjected to repeated salt spray tests and outdoor exposure tests. When the test cycle is complete the sheet is examined to determine the extent and density of scab corrosion and an assessment is made on a scale ranging from 0 to 6.

It is clear from FIGS. 3 and 4 that the scab corrosion resistance after coating improves as the value of P/P+H increases in all cases. As mentioned earlier the zinc ion concentration in the treatment solution is of importance for maintaining a high P/P+H value, which is to say that the value of P/P+H is inversely proportional to the zinc ion concentration, and so it is important that the zinc ion concentration be maintained at a low value within the range of possible zinc ion concentrations.

An outline of the relationship between the nickel ion concentration in the treatment solution and the corrosion resistance is shown in FIG. 5. Thus baths were made up using a zinc phosphate conversion coating agent in accordance with the instructions, nickel ions were added at various concentrations (X) ranging from 0.2 to 1.4 g/l and cold rolled steel sheets were subjected to a forming treatment as specified in the instructions in these baths. The results (Y) of corrosion tests carried out after coating these sheets were as shown in FIG. 5. A poor result has a Y value of 1 and the value of Y increases as the corrosion resistance improves. On looking at FIG. 5 it is clear that the nickel ion concentration has a considerable effect on the corrosion resistance of the sheets after coating and that a nickel ion concentration in the range 0.5–1.2 g/l is preferred. Hence it is necessary to control the nickel ion concentration in the treatment solution as well as the zinc ion concentration.

Thus on the basis of the facts described above it is clear that, in connection with the method of control of this invention, it is necessary to control the zinc ion concentration and the zinc+nickel ion concentration in the treatment solution if coatings of consistently high quality are to be formed. The method of control of this invention is described in more detail below.

The value of P/P+H was 0.85 for the coating obtained by spraying automobile steel sheet (SPCC-D) for 2 minutes with a treatment solution at 55° C. which had a total acidity of 20 points, a phosphate ($PO_4$) ion concentration of 15 g/l, a zinc ion concentration of 0.8 g/l, a nickel ion concentration of 0.7 g/l and which also contained nitrate ions ($NO_3$), chlorate ions ($ClO_3$), nitrite ions ($NO_2$), fluoride (F) ions and sodium ions. The P/P+H value could be maintained at 0.85±0.05 by controlling the total acidity of the treatment solution to 20±1 point, the free acidity to 1±0.1 point, the zinc ion concentration to 0.8±0.1 g/l, the nickel ion concentration to 0.7±0.1 g/l and the promotor ($NO_2$) concentration to 2.5±0.5 points.

It is difficult to control the zinc ion concentration to within the range of 0.8±0.1 g/l using an ion meter which has a sensitivity of ±1–±2 mV since the potential difference in this case is only 3.2 mV. Hence in the control method of this invention a complexometric titration is carried out using EDTA to determine the zinc ion concentration and the zinc ion+nickel ion concentration on the basis of the change in potential which occurs in this case.

Figure 6:
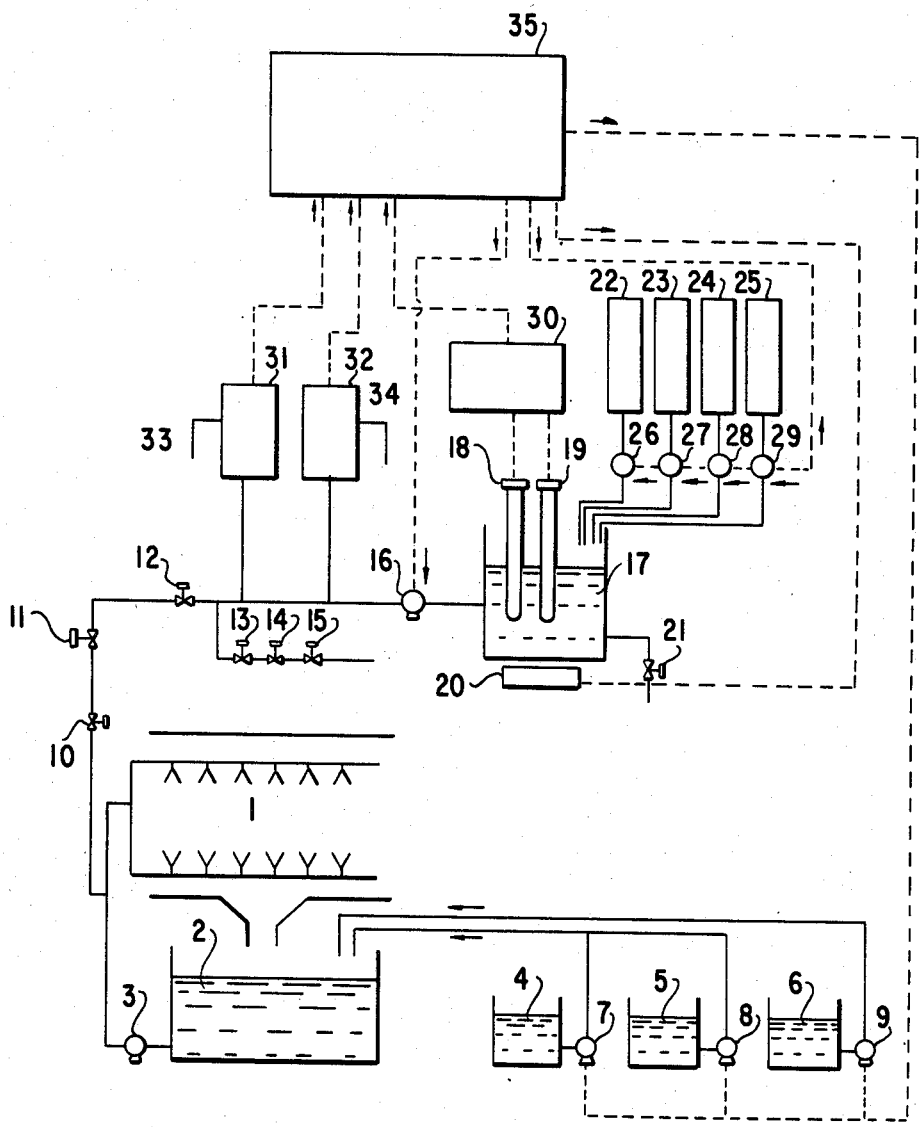
FIG. 6 is an outline drawing of an example of treatment solution automatic control equipment using the control method of this invention.

An outline of the equipment for controlling the treatment solution automatically installed in a metal surface treatment plant for realizing the control method of this invention is described below with reference to FIG. 6. Thus in FIG. 6, 1 is the spray zone of the treatment plant and treatment is achieved with a circulating system in which the treatment solution in the treatment solution tank 2 is taken up and sprayed out by the pump 3. The treatment solution tank 2 is provided with the service tank 4 for supplying phosphate replenisher with a high zinc content, the service tank 5 for supplying phosphate replenisher which a low zinc content and the service tank 6 which supplies the promotor and these tanks are established close by so that each of these liquids can be supplied to the treatment solution tank 2 by means of the pumps 7, 8 and 9 respectively.

Some of the treatment solution which has been drawn up from the aforementioned treatment solution tank 2 by the pump 3 is split off as a test sample before spraying and transferred via the needle valve 10, the pressure reducing valve 11, the electromagnetic valve 12 and the prominent pump 16 into the cell 17. Moreover the excess sample solution which has been drawn up is returned to the aforementioned treatment tank 2 via the check valve 13, the electromagnetic valve 14 and the needle valve 15. The calcium ion electrode 18 and the reference electrode 19 are established in the aforementioned cell 17 which is also provided at the bottom with the stirrer 20 for agitating the liquid in the cell and the drain valve 21 for exhausting the liquid from the cell.

A sample of volume about 10 ml is deposited in the cell 17 and 15 ml of reagent A (0.02 M EDTA solution) from the reagent tank 22 and 10 ml of reagent B from the reagent tank 23 (reagent B is a mixture of pH 10 buffer solution and ion stength controlling agent ISA prepared by dissolving 70 grams of ammonium chloride in water, adding 570 ml of concentrated aqueous ammonia and making up to a total volume of 1 liter and mixing this solution with 1 liter of 5M aqueous sodium chloride solution) are added to the sample via the prominent pumps 26 and 17 and the mixture is agitated with the stirrer 20. The liquid in the cell is then left to stand for 1–3 minutes and if there is no change to be seen in the potential of the calcium ion electrode 18 before and after standing the titrant (0.02M aqueous calcium chloride solution) is added in 0.1 ml aliquots to the cell 17 from the titrant tank 25 via the prominent pump 29. The change in the potential of the calcium ion electrode 18 which accompanies the addition of the titrant is read out and the maximum value of the differential value of the change in this potential is taken as the end point of the titration. The titre at this time is obtained as "a" ml.

The drain valve 21 is then opened and the liquid is exhausted from the cell which is then rinsed out with water. Next a further 10 ml sample of treatment solution is collected in the cell 17 in the same way as described above and, as before 15 ml of reagent A and 10 ml of reagent B are added to the cell, along with 10 ml of reagent C (a 0.2M aqueous solution of ammonium glycolate) from the reagent tank 24 via the prominent pump 28 and the mixture is agitated. The titrant is then added in 0.1 ml aliquots and the change in the potential of the calcium ion electrode 18 is read out in the same way as described above. Here again the maximum value of the differential value is taken to be the end point and the titre at this time is obtained as "b" ml.

Data put out on the basis of the changes in potential are fed to the control part 35 via the output converting part 30 and, on the basis of the data received, the zinc ion concentration or, in the case of a treatment solution which contains nickel, the zinc ion concentration and the total zinc ion+nickel ion concentration, is computed in the said control part 35 using the equations given below. Moreover as in the past a sample of the treatment solution is introduced into the promotor concentration measuring device 31 and the total acid concentration measuring device 32 for the measurement of the promotor concentration, the total acid and the free acid in the treatment solution and the data from these measuring devices are input to and dealt with in the control part 35.

| | |
|---|---|
| Zinc ion + nickel ion concentration | $= 0.02 \times (15 - a) \div 10$ mol/l |
| Nickel ion concentration | $= 0.02 \times (15 - b) \div 10$ mol/l |
| | $= 0.02 \times (15 - b) \div 10 \times 58.69$ g/l |
| Zinc ion concentration | $= 0.02 \times (b - a) \div 10$ mol/l |
| | $= 0.02 \times (b - a) \div 10 \times 65.38$ g/l |

Figure 7:
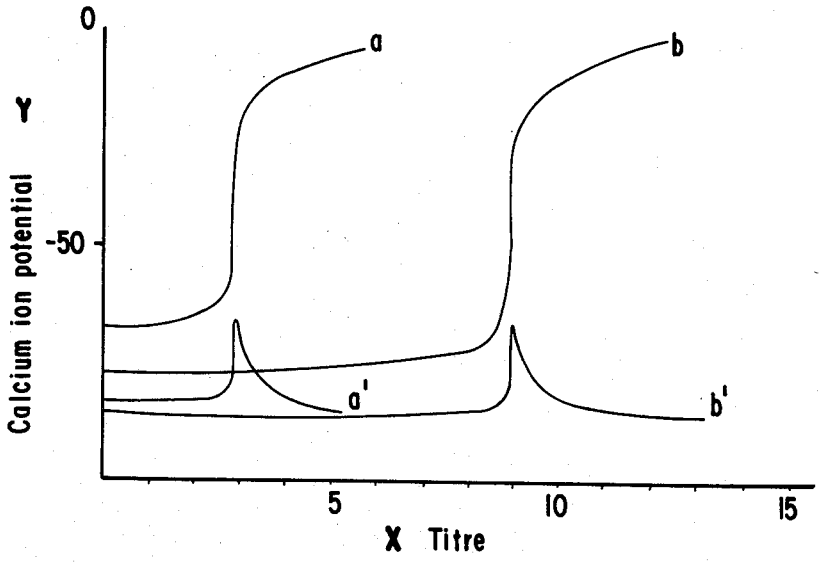
FIG. 7 shows graphs of the relationships between the titre and the change in the potential when treatment solutions were titrated complexometrically using a calcium ion electrode.

The relationship between the change in the potential and the titre when the treatment solution is titrated complexometrically using a calcium ion electrode is shown graphically in FIG. 7, where X represents the titre (ml) of 0.02M calcium chloride titrant solution and Y is the calcium ion potential. The curves shown in FIG. 7 are as follows:

a : Curve obtained when EDTA was added alone.

a': Differential values of curve a.

b : Curve obtained when ammonium thioglycolate and EDTA were both added.

b': Differential values of curve b.

Once the concentrations in the treatment liquor have been determined using a procedure of the type described above the pumps 7, 8 and 9 of the service tanks 4, 5 and 6 respectively are driven by means of signals from the control part 35 via the broken lines in FIG. 6 when the concentrations reach the lower levels of the control ranges and the various replenishers and the promotor are supplied independently to the treatment tank 2. The supply of replenisher and promotor gradually increases the concentrations of the various components in the treatment solution in the treatment tank 2 and when the concentrations reach the upper limits of the control ranges a signal indicating that this level has been reached is put out from the cell 17 to the control part 35, signals are generated for stopping the supply of replenisher and promotor and the pumps 7, 8 and 9 are stopped. It is possible in this way to maintain the concentration of each component in the treatment solution within the control range automatically. As an example the concentrations of the components in a treatment solution which did not contain nickel ions are shown in Table 3 along with the actions for replenishment due to the signals.

TABLE 3

| Total Acid | Zinc Ion | Promotor conc. | Replenishment Indications |
|---|---|---|---|
| Down | Down | Down | Replenisher B + Promotor |
| Down | OK | Down | Replenisher B + Promotor |
| OK | Down | Down | Use Replenisher A for further replenishment, Promotor |
| OK | Up | Down | Use Replenisher B for further replenishment, Promotor |
| Down | Up | Down | Replenisher B + Promotor |
| Down | OK | Down | Replenisher B + Promotor |
| Up | Down | Down | Replenisher A + Promotor (The former replenisher corresponds with the reduction of total acid) |
| Up | Up | Down | Promotor (Replenisher supply temporarily stopped) |
| Up | Up | Up | Supply of replenisher and promotor temporarily stopped |

(NOTES)
Down: Indicates the lower limit of the control range has been reached.
Up: Indicates the upper limit of the control range has been reached.
OK: Indicates that the result is within the control range.

Furthermore a summary of the treatment control data and the values of P/P+H of the coatings formed on the surface of cold rolled steel sheets when automatic control of this invention had been used in an actual spray treatment line is shown in Table 4, but the data and operation for the control and replenishment of the promotor are omitted.

TABLE 4

| | Titre*1 | | Treatment Solution Composition | | | Replenishment Rate (kg/hr) | | Coating |
|---|---|---|---|---|---|---|---|---|
| Time | a ml | b ml | Zn g/l 0.8 ± 0.5 | Ni g/l 0.7 ± 0.5 | Total acid 20 + 1 point | Replenisher A*2 | Replenisher B*3 | P/(P + H) |
| 9-00 | 2.9 | 9 | 0.8 | 0.7 | 20.1 | 25 | 25 | 0.86 |
| 9-30 | 3.0 | 9.1 | 0.8 | 0.69 | 19.6 | 32.6 | 26.6 | 0.83 |
| 10-00 | 2.5 | 8.8 | 0.82 | 0.73 | 20.5 | 19.3 | 19.3 | 0.85 |
| 10-30 | 3.0 | 9.1 | 0.80 | 0.69 | 19.7 | 27.0 | 29.9 | 0.83 |
| 11-00 | 2.5 | 8.8 | 0.82 | 0.73 | 20.6 | 18.1 | 18.1 | 0.84 |
| 11-30 | 3.0 | 9.1 | 0.80 | 0.69 | 19.4 | 28.7 | 35.1 | 0.82 |
| 12-00 | 2.5 | 8.9 | 0.83 | 0.72 | 20.5 | 18.3 | 20.2 | 0.85 |
| 12-30 | 2.8 | 9.0 | 0.81 | 0.70 | 19.8 | 24.6 | 30.0 | 0.82 |
| 13-00 | 2.6 | 9.0 | 0.83 | 0.71 | 20.3 | 19.4 | 23.7 | 0.84 |
| 13-30 | 3.0 | 9.0 | 0.79 | 0.70 | 19.8 | 27.3 | 27.3 | 0.86 |
| 14-00 | 2.7 | 8.9 | 0.80 | 0.72 | 20.2 | 23.8 | 21.6 | 0.87 |

Treatment solution: $10m^3$
(Notes)
*1 0.02M aqueous calcium chloride solution.
*2 Principal components Zn 2.18%, Ni 1.76%, $PO_4$ 27.2%.
*3 Principle components Zn 1.31%, Ni 1.76%, $PO_4$ 27.2%

In the data shown in Table 4 the zinc ion and the nickel ion concentrations and the total acid are maintained within the limits of 0.8±0.5 g/l, 0.7±0.5 g/l and 20±1 point respectively and the value of P/P+H for the coating is maintained consistently at a high value of 0.82–0.87.

Thus by controlling the zinc ion and nickel ion concentrations within suitable ranges it is possible to form consistently high quality coatings which have a high value for P/P+H, which is to say that it is possible to form consistently coatings which have a high phosphophilite content.

The control method for zinc phosphate based conversion coating treatment solutions of this invention involves removing samples of the treatment solution and determining the zinc ion and nickel ion concentrations or the total zinc ion+nickel ion concentration in the sample, the concentrations detected being the concentrations of each component in the treatment solution. The treatment solution is then controlled on the basis of these concentrations and so it is possible without difficulty to control the concentrations of these components precisely and it is possible to form consistently coatings of high quality because of this accurate control, a result which has not been possible in the past where the zinc ion and nickel ion concentrations have not been measured directly and where control has been achieved by determining the free acid, the total acid and the promotor concentrations, and this invention provides superior results.

What is claimed is:

1. A process for controlling the content of zinc plus nickel of a zinc phosphate bath, comprising:

(1) obtaining a bath sample of known volume;

(2) adding a quantity of ethylene diamine tetraacetic acid (EDTA), in the form of an aqueous solution, in a predetermined amount sufficient to yield an excess of EDTA over that required to complex the zinc and nickel present;

(3) adding a buffering solution;

(4) titrating the resulting solution by the addition of an aqueous calcium solution in the presence of a calcium ion electrode to the end point indicated by maximum rate of change of the electrode value whereby the content of zinc plus nickel is determined; and (5) making additions to the bath to control zinc and nickel at the desired level.

2. The process of claim 1 wherein the bath contains both zinc and nickel and wherein it is desired to individually control the content of zinc and nickel comprising:

(1) obtaining a second bath sample of known volume;

(2) adding a quantity of ammonium thioglycolate and EDTA in the form of an aqueous solution in predetermined amounts so that the thioglycolate complexes all of the zinc present and the EDTA is in excess of the amount required to complex the nickel present;

(3) adding a buffering solution;

(4) titrating the resulting second sample solution by the addition of an aqueous calcium solution in the presence of a calcium ion electrode to the end point indicated by maximum rate of change of the electrode value whereby the nickel content (and zinc content by difference from the total of zinc and nickel determined for sample 1) is determined; and (5) making individual zinc and nickel ion additions to the bath to control their concentrations at the desired level.

3. The process of claim 1 wherein the additions are made automatically.

4. The process of claim 2 wherein the additions are made automatically.

* * * * *

UNITED STATES PATENT AND TRADEMARK OFFICE

CERTIFICATE OF CORRECTION

PATENT NO. : 4,612,060

DATED : September 16, 1986

INVENTOR(S) : R. Kojima; N. Suzuki; Y. Sato; T. Saito

It is certified that error appears in the above-identified patent and that said Letters Patent are hereby corrected as shown below:

At column 4, line 5 The first word --in-- should be "is"

At column 4, line 6 The numbers --$Z_3$32 1.65-- should be "$Z_3$=1.65"

Signed and Sealed this

Second Day of December, 1986

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,612,060

DATED : September 16, 1986

INVENTOR(S) : Ryuiji Kojima, et al

It is certified that error appears in the above-identified patent and that said Letters Patent is hereby corrected as shown below:

On the title page assignee should read

-- (73) Assignee: Nihon Parkerizing Co., Ltd.
Tokyo, Japan --.

Signed and Sealed this

Seventeenth Day of March, 1987

*Attest:*

DONALD J. QUIGG

*Attesting Officer*

*Commissioner of Patents and Trademarks*